United States Patent [19]

Mrenna et al.

[11] Patent Number: 4,698,606

[45] Date of Patent: Oct. 6, 1987

[54] CIRCUIT BREAKER WITH ADJUSTABLE THERMAL TRIP UNIT

[75] Inventors: Stephen A. Mrenna, Brighton Township, Beaver County; Michael J. Whipple, New Sewickley, both of Pa.

[73] Assignee: Westinghouse Electric Corp., Pittsburgh, Pa.

[21] Appl. No.: 876,557

[22] Filed: Jun. 20, 1986

[51] Int. Cl.[4] ..... H01H 75/08; H01H 77/04

[52] U.S. Cl. ..... 335/45; 337/49; 337/82

[58] Field of Search ..... 335/8–10, 335/45; 337/45–49, 70, 82

[56] References Cited

U.S. PATENT DOCUMENTS

| | | | |
|---|---|---|---|
| 3,526,861 | 9/1970 | Walker . | |
| 3,659,241 | 4/1972 | Yorgin . | |
| 3,797,007 | 3/1974 | Salvati . | |
| 3,944,959 | 3/1976 | Kidd | 335/45 |
| 4,030,060 | 6/1977 | Mrenna . | |
| 4,074,218 | 2/1978 | Salvati . | |

FOREIGN PATENT DOCUMENTS

| | | | |
|---|---|---|---|
| 234195 | 11/1963 | Austria | 337/49 |

*Primary Examiner*—E. A. Goldberg
*Assistant Examiner*—Lincoln Donovan
*Attorney, Agent, or Firm*—L. P. Johns

[57] ABSTRACT

A circuit interrupter responsive to abnormal currents in conductors of an electrical distribution system characterized by a circuit breaker mechanism for opening and closing separable contacts and which mechanism comprises a releasable member operable between latched and unlatched positions, trip means comprising a bimetal element and a trip bar movable to unlatch the circuit breaker mechanism and biased in the latched position, the trip bar having a surface facing and spaced from the bimetal element which surface is slanted at an oblique angle to the longitudinal axis of the trip bar, and manually adjustable knob connected to the trip bar for sliding the trip bar longitudinally to vary the space between the bimetal element and the trip bar surface in accordance with a desired thermal rating.

9 Claims, 10 Drawing Figures

FIG. 4
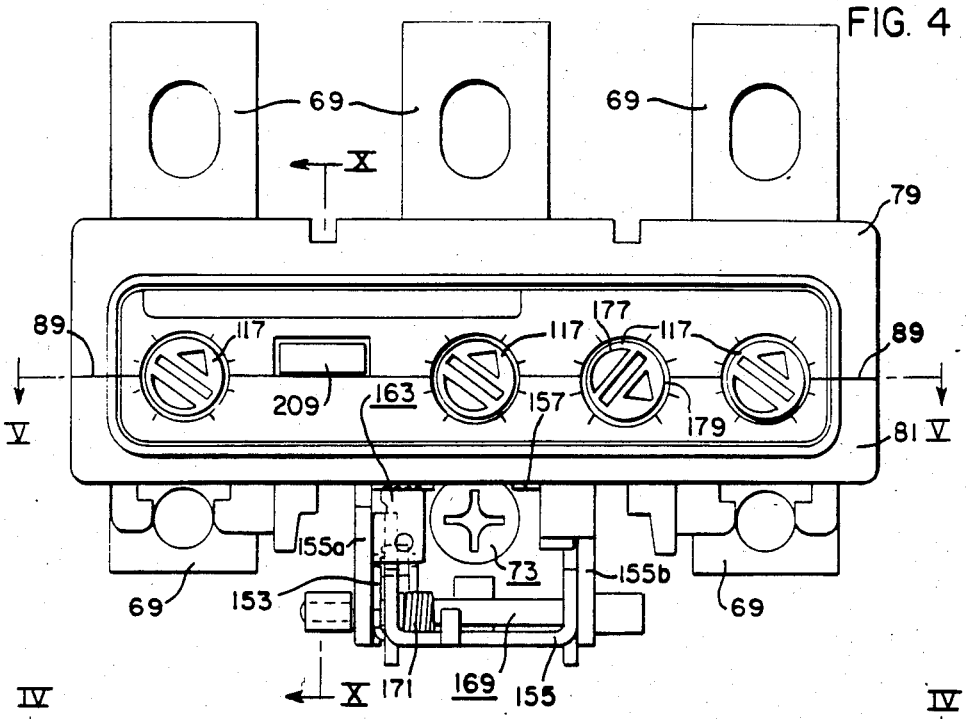
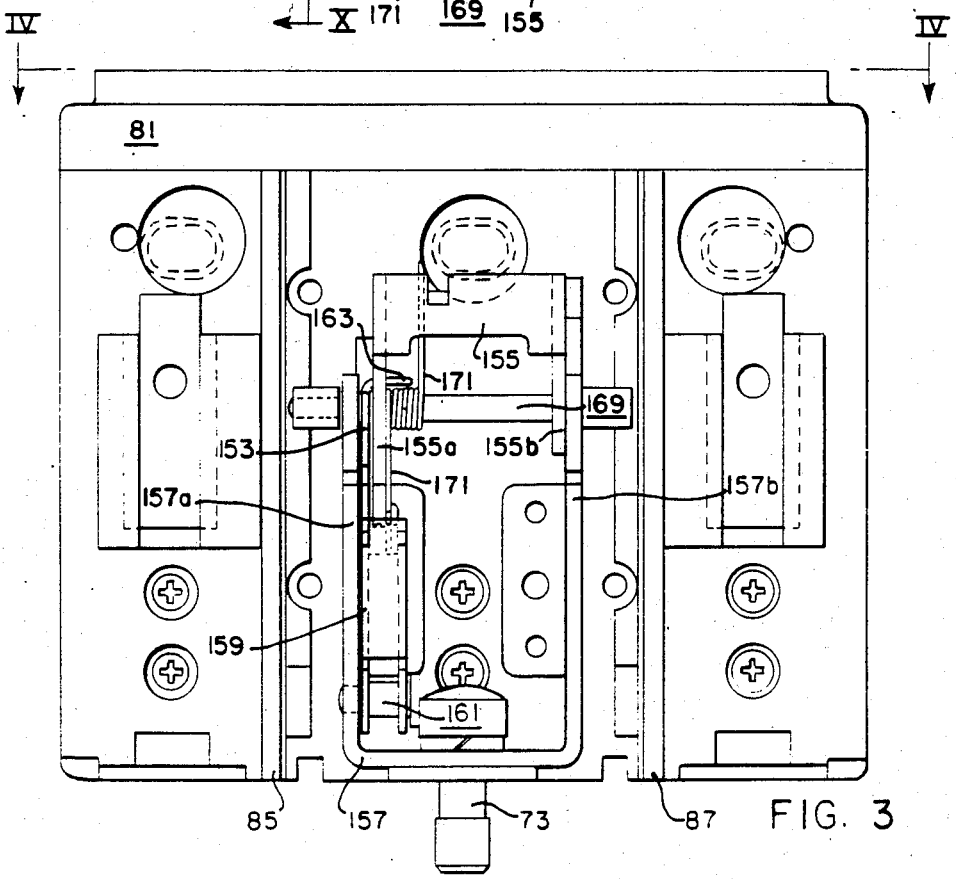
FIG. 3

CIRCUIT BREAKER WITH ADJUSTABLE THERMAL TRIP UNIT

CROSS REFERENCE TO RELATED APPLICATION

This application is related to copending application Ser. No. 858,137, filed Apr. 30, 1986, entitled "Circuit Breaker with Adjustable Magnetic Trip Unit," of which the inventors are S. A. Mrenna and M. Whipple assigned to the assignee of this application.

BACKGROUND OF THE INVENTION

1. Field of the Invention

This invention relates to a protective device for a circuit interrupter and, more particularly, it pertains to an adjustable thermal trip unit for varying the thermal rating of the circuit breaker.

2. Description of the Prior Art

Circuit breakers having thermo tripping mechanisms are well known in the art and consist primarily of a movable trip bar which carries a releasable latch. As shown in U.S. Pat. No. 3,211,860, the trip bar is actuated by adjacent bimetal strips which respond to temperature generated by an overflow current flowing through the circuit breaker. A circuit breaker of that type is set for a given amperage rating which is conventional for circuit breakers used in some countries such as the United States. There is, however, a preference for manually adjustable thermal tripping devices to change the thermal rating of the circuit breaker to suit load requirements.

SUMMARY OF THE INVENTION

In accordance with this invention a multi-pole circuit breaker is provided which comprises a circuit breaker structure having a plurality of pole units, each pole unit comprising a pair of contacts, releasable means including a releasable arm to effect simultaneous opening of all of said pairs of contacts; trip means for each of the pole units, each trip means having a bimetal element responsive to the occurrence of overload current conditions to effect release of the releasable means, the trip means also comprising a trip bar that is movable longitudinally; the trip bar having a ramp with a surface facing and spaced from each bimetal element which surface is inclined at an angle to the longitudinal axis of the trip bar; adjusting means associated with the trip bar for adjustably moving the trip bar longitudinally to a position corresponding to the desired thermal rating spacing, whereby the longitudinal position of the trip bar establishes the thermal rating spacing, the adjusting means comprising a rotatable handle supported adjacent to the trip bar and a handle engaging structure on the trip bar, the trip unit comprising an electomagnetic trip including a magnetic core and armature structure supported to be energized by the full current in the circuit and calibrated so that upon the occurence of an overload current, the armature structure moves towards the core to operatively move the trip bar, and the trip unit also comprising a manual trip member supported for pivotal movement of the trip bar.

The advantage of the circuit breaker structure of this invention is that it provides an adjustable thermal rating mechanism that obviates the need for stocking a supply of separate rating plugs for various current ratings.

BRIEF DESCRIPTION OF THE DRAWINGS

FIG. 3 is an elevational view taken on the line III—III of FIG. 2;

FIG. 4 is a plan view taken on the line IV—IV of FIG. 3;

DESCRIPTION OF THE PREFERRED EMBODIMENT

Figure 1:
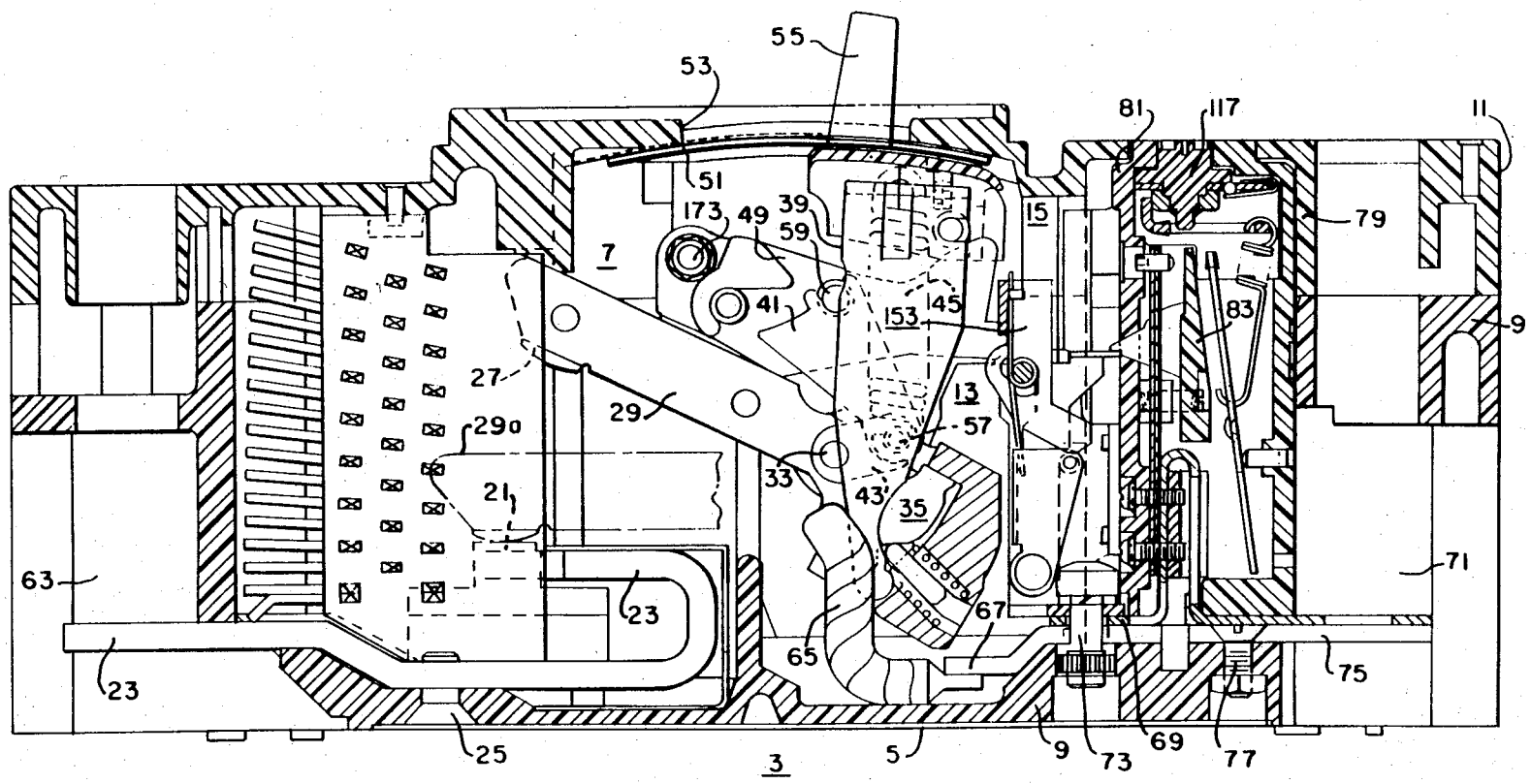
FIG. 1 is a vertical sectional view through a multiple-pole circuit breaker.

In FIG. 1, a circuit breaker is generally indicated at 3 and it comprises an insulating housing 5 and a circuit breaker mechanism 7 supported within the housing. The housing 5 having an insulating base 9 and an insulating cover 11.

The circuit breaker mechanism 7 includes an operating mechanism 13, and a latch and trip device 15. Except for the latch and trip device, the circuit breaker 3 is of the type that is generally described in U.S. Pat. No. 3,797,009 and is incorporated by reference herein. The circuit breaker 3 is a three-pole circuit breaker comprising three compartments disposed in side-by-side relationship. The center pole compartment (FIG. 1) is separated from the two outer pole compartments by insulating barrier walls formed with the housing base 9 and cover 11. The operating mechanism 13 is disposed in the center pole compartment and is a single operating mechanism for operating the contacts of all three pole units.

Each pole unit comprises a stationary contact 21 that is fixedly secured to a rigid main conductor 23 that in turn is secured to the base 9 by bolts 25. In each pole unit, a movable contact 27 is secured, such as by welding or brazing, to a contact arm 29 that is mounted on a pivot pin 33. The arm 29 for all three of the pole units is supported at one end thereof and rigidly connected on a common insulating tie bar 35 by which the arms of all three pole units move in unison. Each of the contact arms 29 is biased about the associated pivot pin 33.

The operating mechanism 13 actuates the switch arms 29 between open and closed positions. The mechanism comprises a pivoted formed operating lever 39, a toggle comprising two toggle links 41 and 43, overcenter spring 45, and a pivoted releasable cradle or arm 49 controlled by the trip device 15. An insulating shield 51 for substantially closing an opening 53 in the cover 11, is mounted on the outer end of the operating lever 39 and has an integral handle portion 55 extending out through the opening to enable manual operation of the breaker. The toggle links 41 and 43 are pivotally connected together by a knee pivot pin 57. The toggle link 41 is pivotally connected to the releasable arm 49 by a pin 59, and the toggle link 43 is pivotally connected to the switch arm 29 of the center pole unit by the pin 33.

The overcenter spring 45 is connected under tension between the knee pivot pin 57 and the outer end of the operating lever 39. The circuit breaker is manually operated to the open position by movement of the handle portion 55 in a clockwise direction, which movement actuates the overcenter spring 45 to collapse the toggle links 41 and 43 to the "OFF" position (FIG. 1), and opening movement of the contact arm 29 for all of the pole units in a manner well known in the art.

The circuit breaker is manually closed by counterclockwise movement of the handle portion 55 from the "OFF" position to the "ON" position, which movement causes the spring 45 to move overcenter and straighten the toggle links 41, 43, thereby moving the contact arm 29 for all of the pole units to the closed position as shown in broken line position 29*a*.

The trip device 15 serves to effect automatic release of the releasable cradle or arm 49 and opening of the breaker contacts for all of the pole units, in response to predetermined overload conditions in the circuit breaker through any or all pole units of the circuit breaker, in a manner described hereinbelow.

A circuit through each pole unit extends from a left-hand terminal 63 through the conductor 23, the contacts 21, 27, the contact arm 29, a flexible conductor 65, a conductor 67, a trip conductor 69, and to a right-hand terminal connector 71. Bolt 73 secures one end of the trip conductor 69 to the conductor 67 and the other end of the trip conductor 69 is disposed between a backup plate 75 and the terminal 71 where it is secured in place by mounting bolt 77 of the terminal 71.

Figure 2:
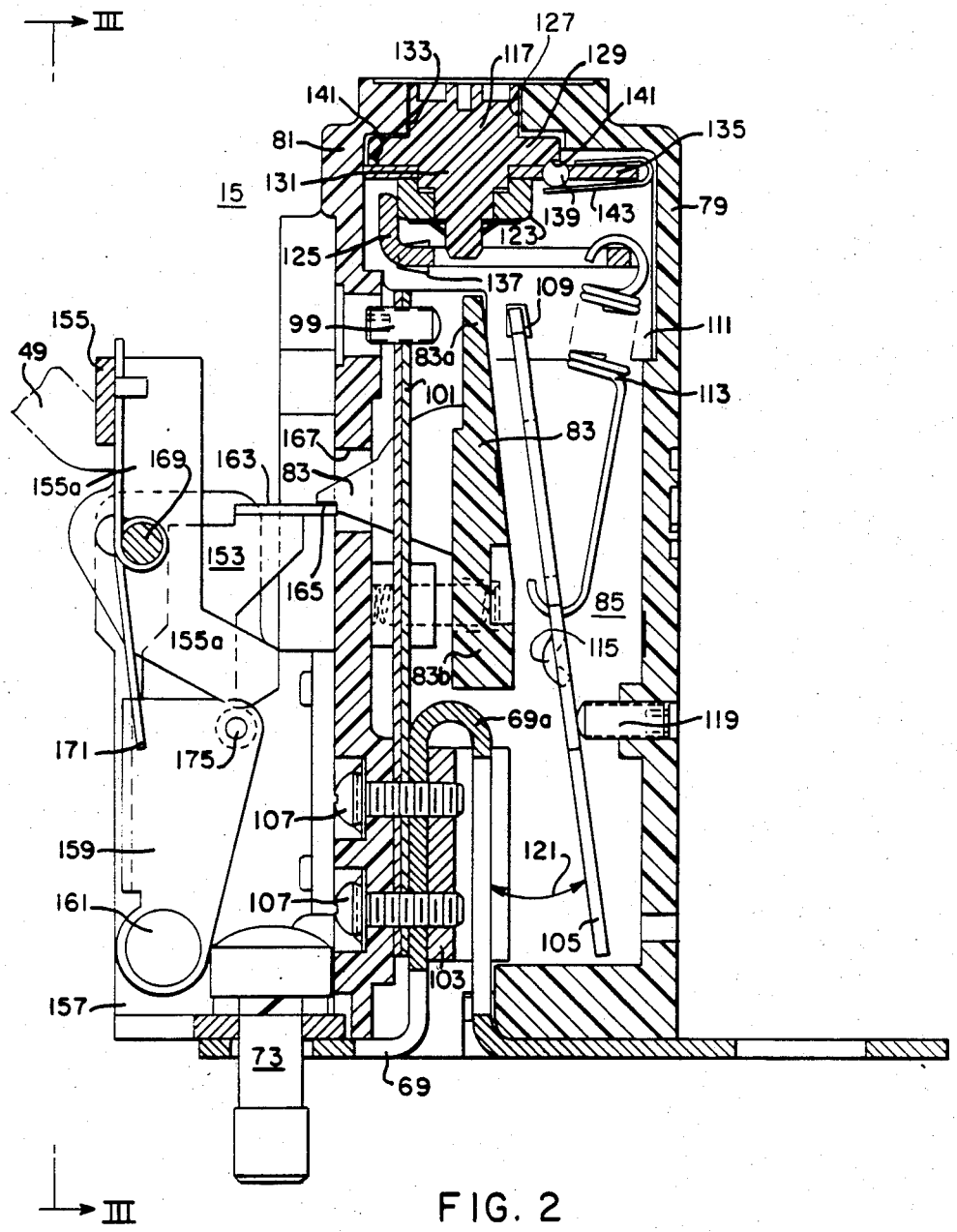
FIG. 2 is an enlarged vertical sectional view of the trip unit.

As shown in FIGS. 2–4 the latch and trip device 15 comprises a molded insulating housing base 81 and a molded insulating housing cover 79 secured to the base to enclose a molded insulating trip bar 83 that is common to all three of the pole units. The base 81 (FIG. 5) includes a pair of spaced partitions 85 and 87 which are vertically disposed and integral with the base for separating the interior of the housing into three compartments, each compartment containing one of the three poles. In a similar manner, the cover 79 (FIG. 4) is provided with partitions corresponding to partitions 85 and 87 and having mating surfaces therewith in a manner similar to the mating surfaces of the peripheral surfaces of the base 81 and cover 79 as indicated by a parting line 89.

The partitions 85 and 87 serve as journals for the trip bar 83. Accordingly, when the housing base 81 and cover 79 are assembled, the trip bar 83 (FIG. 2) is retained in place and is free to rotate. Each section of the trip bar 83 located within the space compartments of the housing comprises upper and lower portions 83*a* and 83*b*, which are above and below the axis of rotation of the trip bar. Each upper portion 83*a* cooperates with a screw 99 on a bimetal member 101 for adjusting the spacing between the upper ends of the bimetal member and the trip bar portion 83*a* in response to the degree of deflection of the upper end of the member 101 toward the member 83*a*, whereby the trip bar 83 is rotated clockwise by the bimetal member and thereby trips the circuit breaker to the open position. The lower end portion 83*b* of the trip bar 83 is rotated by an armature 105 in the manner to be described hereinbelow.

The trip conductor 69 (FIG. 2) includes an inverted U-shaped intermediate portion 69*a* which consitutes a single loop of a stationary magnetic, which comprises a magnetic core 103 and the armature 105. The assembly of the intermediate U-shaped portion 69*a*, the core 103, and the lower portion of the bimetal member 101 are secured in place by suitable means, such as screws 107, on the housing base 81. The lower end portion of the bimetal member 101 is in surface-to-surface contact with the conductor 69, whereby upon the occurrence of a low persistent overload current below a predetermined value of, for example, five times normal rated current, the bimetal member 101 is heated and deflects to the right through an air gap dependent upon the setting of the adjustment screw 99. Thus, the trip bar 83 is actuated to trip the circuit breaker.

Figure 5:
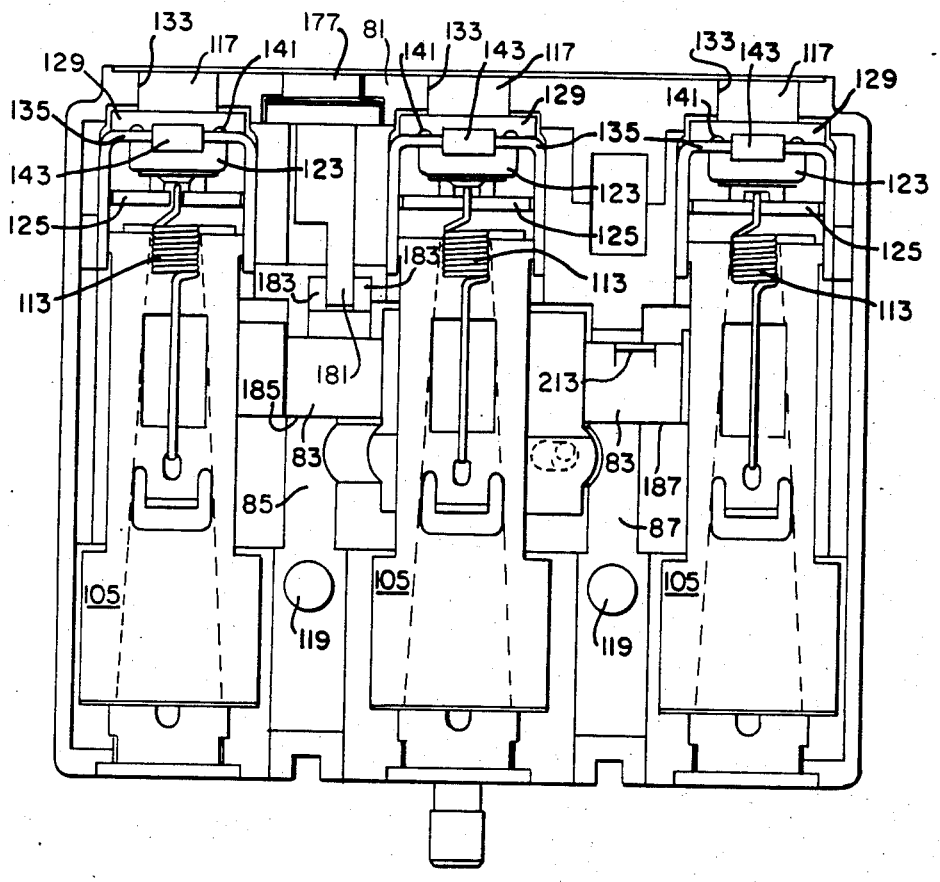
FIG. 5 is a vertical sectional view taken on the line V—V of FIG. 4.
Figure 6:
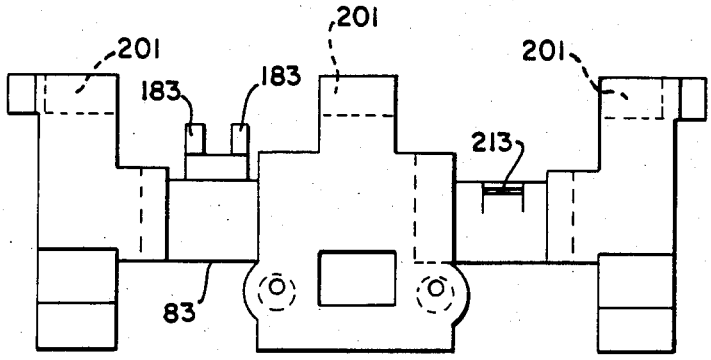
FIG. 6 is a plan view of the trip bar.

The armature 105 is pivotally mounted in an opening 109 on a holding bracket 111 and is biased in the counterclockwise direction by coil springs 113 (FIGS. 2, 5). The armature has a projection 115 and is movable clockwise to rotate the trip bar 83 clockwise. When an overload current above a value such, for example, as five times normal rated current or a short circuit current occurs, the stationary magnetic structure is energized and the armature 105, is attracted toward the core 103, causing release of the arm 49 and opening of the contacts 21 and 27.

A calibration screw 119 is provided in the housing cover 79 for adjusting the spacing between the armature 105 and the core 103, whereby upon maximum spacing of the armature from the core, a greater current overload is required to attract the armature toward the core. Conversely, when the spacing is reduced, a smaller overload current is required to actuate the trip bar 83. However, inasmuch as the trip unit 15 comprises an adjusting knob 117, the calibration screw 119 is preset to a prescribed air gap 121 after final assembly.

The adjusting knob 117 is provided for changing the rating of the circuit breaker 15 by varying the force on the spring 113. The adjusting knob 117 is part of a spring tensioning assembly which also includes a cam 123, and a cam follower 125. The adjusting knob 117 includes a circular surface 127, a radial flange 129, and a shaft 131 on which the cam 123 is mounted. The adjusting knob 117 is mounted within a circular opening 133 of the housing. The adjusting knob 117 is retained in place by a retainer 135 which is part of the holding bracket 111.

The cam follower 125 is a lever, such as a bell crank, having one end portion contacting the surface of the cam 123 and the other end portion connected to the upper end of the coil spring 113. The lower end of the spring is connected to the armature 105. The cam follower is pivotally mounted in an opening 137 of the holding bracket 111. In this manner the tension of the spring 113 holds the cam follower 125 against the cam surface 123.

Associated with the adjusting knob 117 is an index means including a ball bearing 149, and spaced indentations 141 around the lower surface of the radial flange 129 for receiving the ball bearing at prescribed positions of rotation of the index knob 117. A leaf spring 143 retains the ball bearing in place within an aperture of the retainer 135. The ball bearing 149 provides positive indexing or indication of the position of the knob as established by the spaced positions of the indentations 141 around the flange 129. The ball bearing 149 reduces rotational friction by rolling on the surface of the flange 129, thereby facilitating rotation of the kob. When the ball bearing 149 is seated within an indentation 141, any vibrations occurring within the circuit breaker are less likely to change the setting of the knob and thereby alter the rating established thereby.

The mechanism by which the releasable arm 49 is released is shown in FIG. 2. The mechanism includes the trip bar 83, a trip lever 153, and a latch lever 155. A U-shaped mounting frame 157 is mounted on the base 81 with spaced upright sides 157*a* and 157*b* (FIGS. 2, 3, 4) providing mounting support for the levers. The trip lever 153 includes a U-shaped lever 159, the lower end of which is mounted on a pivot pin 161 which extends from the side 157*a* of the frame. The U-shaped lower portion of the lever 159 maintains the lever upright adjacent the frame side 157*a*. The upper end of the trip lever 153 includes a flange 163 which engage a notch 165 on the trip bar 83. As shown in FIG. 2 a portion 83*a* of the trip bar 83 extends through an opening 167 in the insulating base 81.

The latch lever 155 includes down-turned portions 155*a* and 155*b* (FIG. 3) which are mounted on a pivot pin 169 the opposite ends of which are secured in the sides 157*a* and 157*b* of the frame 157. A spring 171 is mounted on the pin 169 and has end portions engaging the levers 153 and 159 for biasing the levers in the latched positions. When the releasable arm 49 is in the latched position (FIG. 1), the arm, which is pivoted on a pivot pin 173, is secured in the latched position below the lever 155 and applies a rotatable force thereon. The latch lever 155 is prevented from turning due to engagement of the lower end of the lever on a pin 175 which is mounted in the U-shaped portion 159 on the trip lever 153. As a result of the rotating force on the latch lever 155, the trip lever 153 is biased clockwise and is prevented from movement by engagement of the flange 163 in the notch 165 of the trip bar 83. When the trip bar is rotated clockwise, the flange 163 is dislodged from the latched position within the notch 165 and the trip lever 153 rotates clockwise to move the pin 175 from engagement with the lower end of the latched lever 155. As a result the latch lever 155 is free to rotate about the pin 169 and thereby unlatch the releasable arm 49 from the latched position.

Figure 7:
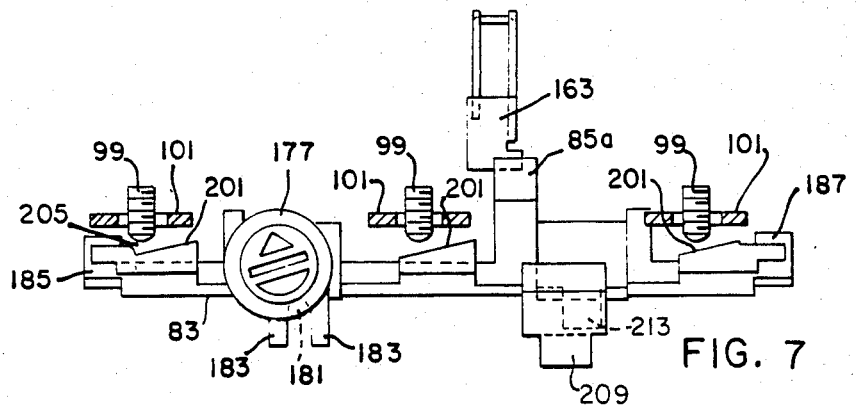
FIGS. 7, 8, and 9 are plan views of the trip bar in high thermal setting, mid-thermal setting, and low thermal setting, respectively.
Figure 8:
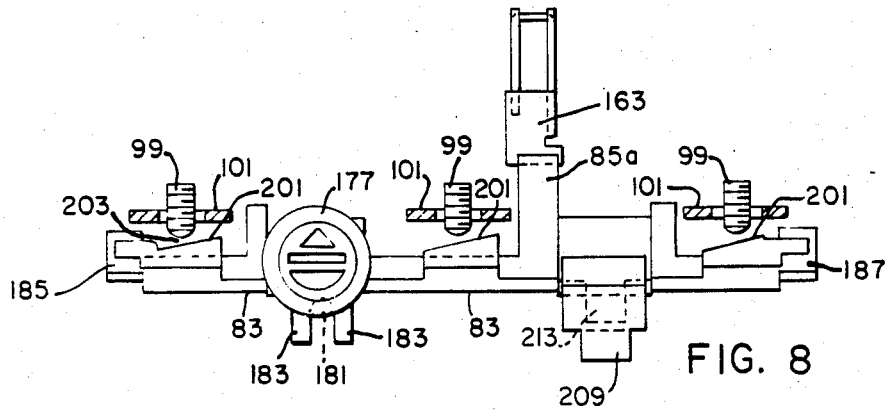
Figure 9:
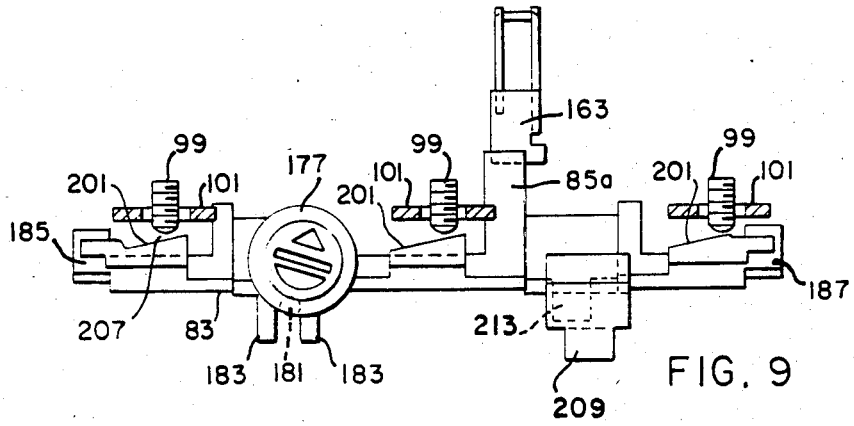

In accordance with this invention, adjusting means are associated with the trip bar for adjustably moving the trip bar longitudinally to a position correspoding to a desired thermal rating spacing, whereby the longitudinal position of the trip bar establishes the spacing required for a particular thermal rating. The adjusting means comprises an adjusting knob 177 (FIGS. 7, 8, 9) which extends through an opening 179 in the cover 79 and base 81 of the trip unit. The knob 177 includes a protuberance or a shaft 181 extending downwardly and between a pair of spaced projections or ears 183 (FIGS. 6, 7, 8, 9) extending outwardly from the trip bar 83. Thus, as the knob 177 is rotated, the trip bar 83 slides longitudinally one way or the other (FIGS. 7, 8, 9). For that purpose, the intermediate portions of the trip bar 83 are slidably mounted at 185, 187 (FIG. 5) in the partitions 87, 85.

In addition, the trip bar 83 includes three ramps having sloped or inclined surfaces 201 (FIGS. 7, 8, 9), one for each of the three poles, which surfaces are inclined at an angle to the longitudinal axis of the trip bar. The inclined surfaces 201 also face the ends of corresponding screws 99 extending from upper ends of the bimetals 101. When the knob 177 is disposed in the position shown in FIG. 8, the spacing 203 between the sloped or inclined surface 201 and the calibrating screw 99 is established for an intermediate thermal setting. When the knob 177 is rotated counterclockwise (FIG. 7), the shaft 181, moving against the ears 183, slides the trip bar 83 to the right, whereby a spacing 205 is established between the surface 201 and the screw 99, which spacing is greater than the spacing 203 for establishing a high thermal setting. On the other hand, when the knob 145 is rotated clockwise, the shaft 181 (FIG. 9), moving against the ears 183, slides the trip bar 83 to the left to provide a spacing 207 (FIG. 9) between the sloped or inclined surface 201 and the screw 99, which spacing is less than that of the spacing 203 (FIG. 8), thereby establishing a low thermal setting for tripping the circuit breaker.

In each of the different thermal setting positions of FIGS. 7, 8, 9, the trip bar portion 85*a* moves laterally with respect to the flange 163 of the trip lever 153. Thus, the movement of the trip bar 83 does not result in disengagement of the flange 163 with the trip bar portion 83*a*.

Figure 10:
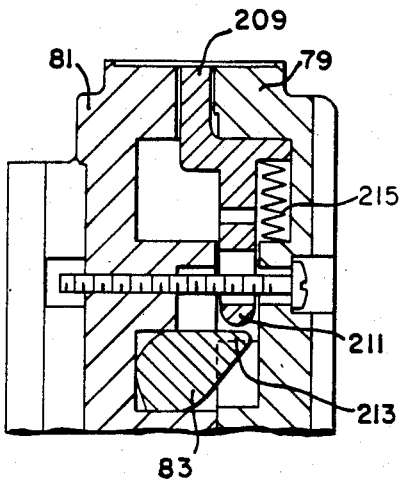
FIG. 10 is a sectional view of the push-to-trip button taken on the line X—X of FIG. 4.

In addition to the foregoing the circuit breaker 3 may be tripped by a "push-to-trip" button 209 (FIGS. 4, 10), having a lower end engageable with a surface 213 of the trip bar 83 (FIGS. 5, 9, 10). A coil spring 215 biases the button 209 (FIG. 10) upwardly and normally free of the surface 213, whereby the trip bar is free to rotate in response to operation of the bimetal 101 and the armature 105.

Accordingly, the device of this invention provides a new and novel adjustable magnetic trip unit for a circuit breaker which avoids the prior requirement for separately insertable and removable rating plugs for each current rating.

What is claimed is:

1. A multi-pole circuit breaker comprising:

a circuit breaker structure having a plurality of pole units;

each pole unit comprising a pair of separable contacts;

releasable means including a releasable arm to effect simultaneous opening of all of said pairs of contacts;

trip means for each of the pole units, each trip means having a bimetal element responsive to the occurrence of overload current conditions to effect release of the releasable means;

the trip means also comprising at least one integral a trip bar that is movable perpendicularly of the bimetal elements;

the trip bar including a ramp having a surface facing and spaced from each bimetal element which surface is inclined at an angle to the perpendicular axis of the trip bar;

the trip bar being rotated to a tripped position when at least one of the bimetal elements moves against a corresponding ramp surface; and adjusting means associated with the trip bar for adjustably moving the trip bar perpendicularly to a position corresponding to the desired thermal rating spacing, whereby the perpendicular position of the trip bar establishes the thermal rating spacing.

2. The device of claim 1 in which the adjusting means comprises a rotatable handle and handle-engaging mechanism, one of which handle and mechanism is mounted on the trip bar and the other of which is mounted adjacent thereto.

3. The device of claim 2 in which the handle-engaging mechanism is mounted on the trip bar.

4. The device of claim 3 in which one of the mechanisms and handles includes the pair of projections and the other of the mechanism and handle includes an extension.

5. The device of claim 4 in which the handle-engaging mechanism includes a pair of spaced projections extending from the trip bar and the handle includes an extension located between the projections.

6. A circuit breaker with adjustable thermal rating in an electrical distribution system comprising:

a circuit breaker mechanism having separable contacts and having a releasable member movable to an unlatched position from a latched position to effect opening of the contacts;

a trip unit movable between latched and unlatched positions of the releasable member and being biased in the latched position;

a trip bar embodied in the trip unit and being rotatable to actuate the trip unit;

a bimetal element responsive to the occurrence of overload current conditions to effect rotation of the trip bar;

the trip bar including a ramp having a surface facing and spaced from the bimetal element which surface is sloped at an inclined angle to the perpendicular axis of the trip bar;

the trip bar being slidable perpendicular to vary the spacing between the bimetal element and the surface;

the trip bar being rotated to a tripped position when the bimetal element moves against the ramp surface; and adjusting means associated with the trip bar for adjustably sliding the trip bar perpendicularly to a position corresponding to the desired thermal rating spacing so that the perpendicular position of the trip bar establishes the spacing.

7. The device of claim 6 in which the adjusting means includes a manual handle connected to the trip bar for sliding the trip bar to change the calibration between the bimetal element and the trip bar surface.

8. The device of claim 7 in which the trip unit comprises an electromagnetic trip including a magnetic core and armature structure supported to be energized by the full current in the circuit, and the electromagnetic trip being so calibrated that upon the occurrence of an overload current in the circuit, the armature structure moves toward the core to operatively move the trip bar.

9. The device of claim 8 in which the trip unit comprises a manual trip member supported for pivotal movement of the trip bar.

* * * * *